US007802552B1

(12) United States Patent
Riley

(10) Patent No.: US 7,802,552 B1
(45) Date of Patent: Sep. 28, 2010

(54) GAS CHANNELING CYLINDER HEAD ASSEMBLY

(75) Inventor: Matthew Riley, Pittsford, MI (US)

(73) Assignee: TSR Technologies, L.L.C., Montpelier, OH (US)

( * ) Notice: Subject to any disclaimer, the term of this patent is extended or adjusted under 35 U.S.C. 154(b) by 294 days.

(21) Appl. No.: 11/740,982

(22) Filed: Apr. 27, 2007

(51) Int. Cl.
*F01L 1/28* (2006.01)
*F01L 1/44* (2006.01)
*F01L 3/20* (2006.01)

(52) U.S. Cl. ..... 123/193.5

(58) Field of Classification Search ... 123/193.1–193.5, 123/184.24, 184.34, 184.47
See application file for complete search history.

(56) References Cited

U.S. PATENT DOCUMENTS

| | | | | |
|---|---|---|---|---|
| 3,042,012 | A | 7/1962 | Buchi | |
| 4,487,171 | A | 12/1984 | Vosper | |
| 5,660,155 | A * | 8/1997 | Taue et al. | 123/184.54 |
| 6,089,196 | A * | 7/2000 | Izuo et al. | 123/90.11 |
| 6,295,961 | B1 | 10/2001 | Carter | |
| 6,571,755 | B1 * | 6/2003 | Dunn et al. | 123/70 R |
| 7,017,538 | B2 | 3/2006 | Lim | |

FOREIGN PATENT DOCUMENTS

| | | | |
|---|---|---|---|
| WO | WO 91/10046 | * | 7/1991 |

* cited by examiner

*Primary Examiner*—M. McMahon
(74) *Attorney, Agent, or Firm*—Kenneth H. Jack; Davis & Jack, L.L.C.

(57) ABSTRACT

A gas channeling cylinder head assembly for fixed attachment to a cylinder, the cylinder having a slidably mounted piston, the piston being cyclically moveable, the assembly incorporating a plenum having a first port, a second port, and a third port, the first port, upon the fixed attachment, communicating with the cylinder; a poppet valve; a solenoid actuator connected operatively to the poppet valve for alternatingly seating and unseating the poppet value at the first port, the solenoid actuator seating and unseating the poppet valve; and a check valve connected operatively to the plenum, the check valve being adapted for alternatingly permitting and resisting inward and outward flows of the gas through the second port; the check valve incorporating a vane which is adapted for movement between flow permitting and flow resisting positions, the vane being positioned for, upon movement to the flow permitting position, directing flows of the gas toward the first port; the assembly further incorporating a second check valve connected operatively to the plenum, the second check valve being adapted for alternatingly permitting and resisting outward and inward flows of the gas through the third port.

18 Claims, 5 Drawing Sheets

GAS CHANNELING CYLINDER HEAD ASSEMBLY

FIELD OF THE INVENTION

This invention relates to reciprocating piston internal combustion engines. More particularly, this invention relates to cylinder head assemblies which are fixedly attachable as components of such engines.

BACKGROUND OF THE INVENTION

Conventional reciprocating piston internal combustion engines commonly incorporate a cylinder head which has a circular intake port which directly communicates with the cylinder and has a circular exhaust port which similarly directly communicates with the cylinder. Flows of combustion and exhaust gases into and out of such ports are typically controlled by at least a pair of mechanically actuated poppet valves which seat at and alternatingly open and close the intake and exhaust ports.

One of the primary advantages of providing an internal combustion engine cylinder head having such intake and exhaust ports directly communicating with the cylinder is that, upon unseating and opening the intake port poppet valve, combustion gases may be injected directly therethrough into the cylinder's combustion chamber. Such direct combustion gas injection tends to enhance cylinder gas pressure and enhance engine performance and efficiency. Yet, such directly communicating cylinder head porting entails certain drawbacks or disadvantages.

One drawback or disadvantage of a directly ported cylinder head derives from the mass of the ports' at least paired poppet valves. The reciprocating motions of typically massive steel intake and exhaust port controlling poppet valves, along with their respective actuating mechanisms, wastes energy and decreases the overall fuel and energy efficiency of the engine.

Another drawback or disadvantage associated with provision of such poppet valve controlled cylinder head intake and exhaust ports derives from the typical geometry of the cylinder and the ports. The cylinder head intake and exhaust ports are desirably circular and large, enhancement of the port's diameter and opening area tending to decrease resistance to flows of combustion and exhaust gasses, and commensurately increasing the fuel and energy efficiency of the engine. Yet, provision of paired or side by side poppet valve controlled intake and exhaust ports limits the diameter of each such port to a dimension which necessarily is less than the circular radius of the cylinder. In order to increase the cumulative intake and exhaust port size, poppet valve controlled intake ports and exhaust ports are known to be paired in a square array of four ports. However, such doubling of the number of ports undesirably doubles the number of massive poppet valves and actuators which must be reciprocatingly mechanically moved, further reducing the mechanical efficiency of the engine.

The instant inventive gas channeling cylinder head assembly advantageously achieves the above described benefits of conventional cylinder head assemblies (i.e., direct cylinder injection of combustion gasses and enhancement of port size) while ameliorating the drawbacks and deficiencies of such assemblies (i.e., fuel efficiency and energy wasting reciprocating motions of multiple massive poppet valves and mechanical actuators) by incorporating into a cylinder head a specialized gas plenum having gas flow directing check valves.

BRIEF SUMMARY OF THE INVENTION

A first structural component of the instant inventive gas channeling cylinder head assembly comprises a hollow gas plenum which is preferably incorporated as an integral component of the cylinder head. Such plenum preferably has a first port, a second port, and a third port.

The plenum's first port is preferably circular and, upon fixed attachment of the inventive cylinder head assembly to an engine block including a reciprocating piston cylinder, preferably communicates directly with the cylinder's combustion chamber. In the preferred embodiment of the instant invention, alternating flows of combustion and exhaust gases through the first port are preferably controlled by a single poppet valve whose stem traverses the hollow interior of the plenum to protrude outwardly therefrom. The outward protrusion of the poppet valve's stem is preferably reciprocatingly actuated by a commonly known poppet valve linear motion actuator which is mounted upon the plenum's exterior. Such actuating means may suitably comprise linear motion actuators in the nature of cam shaft and rocker arm assemblies, electric solenoid actuators, electric servo motor driven actuators, pneumatic cylinder actuators, or hydraulic cylinder actuators.

In the preferred embodiment of the instant inventive cylinder head assembly, the poppet valve which seats at and controls gas flow through the plenum's first port constitutes the plenum's sole mechanically actuated valve. Such minimization of the number of mechanically actuated valves advantageously minimizes energy wasting, reciprocating movements of typically massive steel fluid flow controlling members and their motion actuating assemblies.

Gas flow through the second port (i.e., the intake port) of the plenum component of the instant inventive cylinder head is preferably controlled by a check valve, such valves advantageously being actuatable by gas flow and gas pressure rather than any separate mechanical actuator. Suitably, the check valve which controls flows of gas through the second port may comprise a ball check valve, a swinging element check valve, a clapper check valve, or a lift check valve. However, in the preferred embodiment, the check valve which controls gas flow through the second port comprises a reed valve which incorporates, as its reed element, at least a first flexible blade, and preferably a widened or laterally extending array of such blades. Preferably, each reed valve blade comprises light, durable, highly flexible, and heat resistant material.

The preferred provision at the plenum's second port of a check valve configured as a reed valve is particularly advantageous because reed valves, upon gas flow actuated opening, are typically capable of further functioning as a vane which, upon flexible deflection, may direct gas flowing thereover away from the blade's proximal end and toward the blade's distal end. The instant inventive cylinder head assembly, upon incorporation of a reed valve as the check valve, preferably orients such valve to take advantage of such valve's capacity for performing dual functions of resisting gas back flow and gas flow directing. To enhance the gas directing function, the reed valve is preferably oriented so that, upon flexible opening of the reed valve, the deflected distal end of the valve's blade angularly points toward the first port, allowing the reed valve to function in the manner of a gas flow directing vane to direct combustion gases toward the first port. The blade of the reed valve preferably comprises a light weight and flexible material which minimizes energy dissipation which would otherwise occur upon gas flow induced opening of such valve. The small amount of energy which is dissipated upon such reed valve opening is advantageously harnessed via the reed valve's function as vane which directs combustion gas toward the first port and thence into the cylinder.

In the preferred embodiment of the instant invention, a second oppositely oriented check valve, preferably also a reed type check valve, is provided, such second check valve controlling gas flow through the third port with a similar minimum of energy dissipation.

In operation of the preferred embodiment of the instant inventive cylinder head assembly, a reciprocating linear motion actuator alternatingly seats and unseats the single poppet valve against and away from a seating surface which annularly lines the opening of the first port. During at least portions of the underlying piston's compression and power strokes, the actuator seats the poppet valve, closing the first port, and during at least portions of the piston's intake and exhaust strokes, the actuator oppositely unseats the poppet valve, opening the first port.

During a piston intake stroke with the poppet valve actuating means holding the poppet valve open, combustion gases are inwardly drawn through the second port, thence over the gas directing vane surface of the flexible blade of the specially oriented reed valve, and thence toward and through the first port into the cylinder's combustion chamber. Also during the intake stroke, the preferred second check valve which controls gas flow through the third port advantageously stops any back flow of exhaust gases which might otherwise undesirably intermingle with combustion gases drawn through the second port.

During the piston's opposite exhaust stroke, and following compression and power strokes against a closed poppet valve, the piston drives exhaust gases outwardly through the first port, thence into the plenum, and thence out of the third port, the check valve controlling gas flow through the second port simultaneously stopping any back flow of exhaust gases therethrough.

Accordingly, objects of the instant invention include the provision of a cylinder head assembly which incorporates a plenum having a check valve controlled intake port.

It is a further object of the instant invention to provide such an assembly which provides a reed type back flow checking valve which is oriented for directing combustion gasses in the manner of a vane toward a port which may directly communicate with a cylinder.

Other and further objects, benefits, and advantages of the instant inventive gas channeling cylinder head assembly have been described above, and will become further known to those skilled in the art upon review of the Detailed Description which follows, and upon review of the appended drawings.

BRIEF DESCRIPTION OF THE DRAWINGS

All Figures are Presented Informally

DETAILED DESCRIPTION OF A PREFERRED EMBODIMENT

Figure 1:
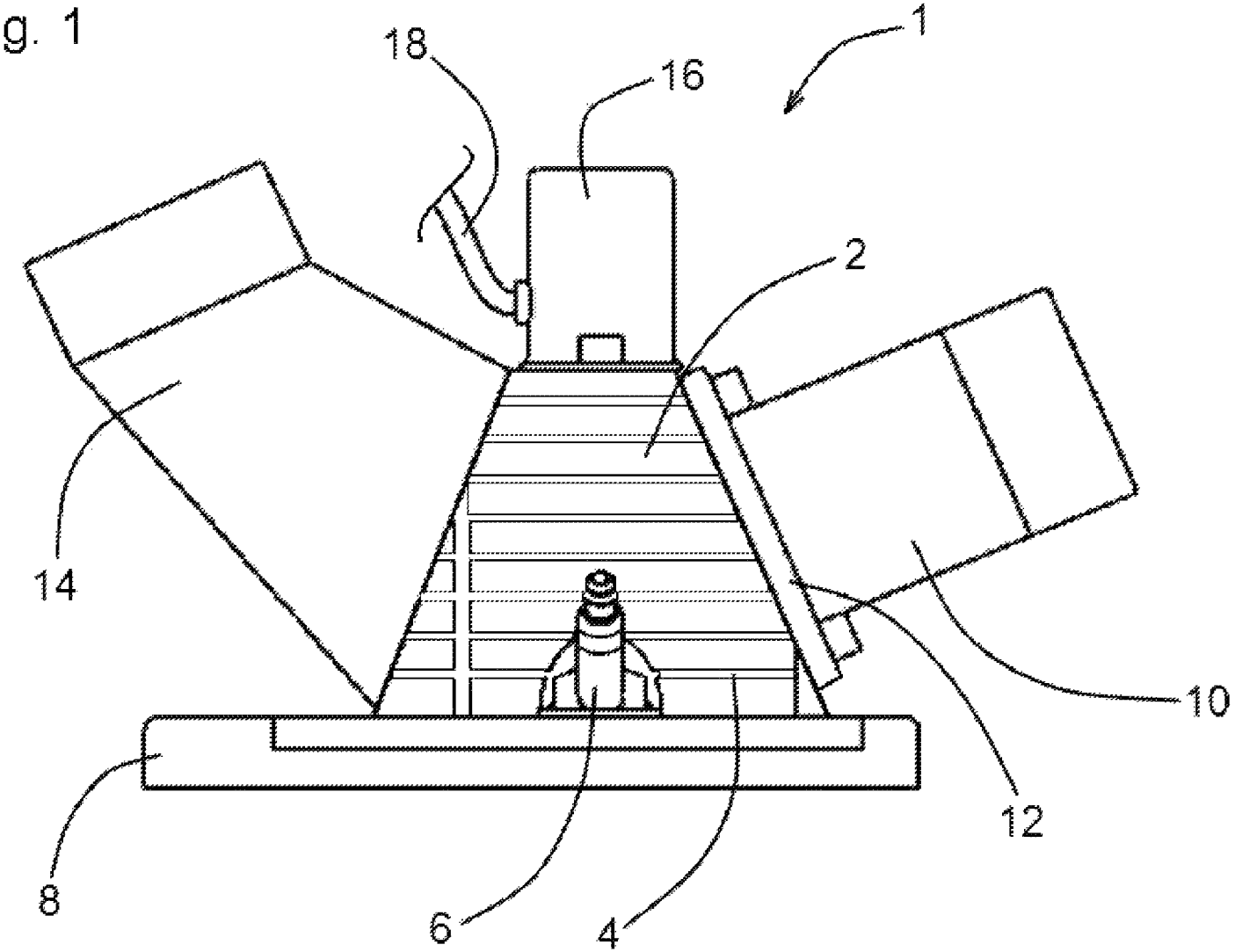
FIG. 1 is a side view of a preferred embodiment of the instant inventive gas channeling cylinder head assembly.

Referring now to the drawings, and in particular to FIG. 1, a preferred embodiment of the instant inventive gas channeling cylinder head assembly is referred to generally by Reference Arrow 1. The assembly 1 preferably comprises a steel base 8, the base 8 being fixedly attachable to a reciprocating piston engine block (not depicted) by bolts (not depicted) which may extend, referring further to FIGS. 3 and 5, through bolt receiving channels 9.

Figure 2:
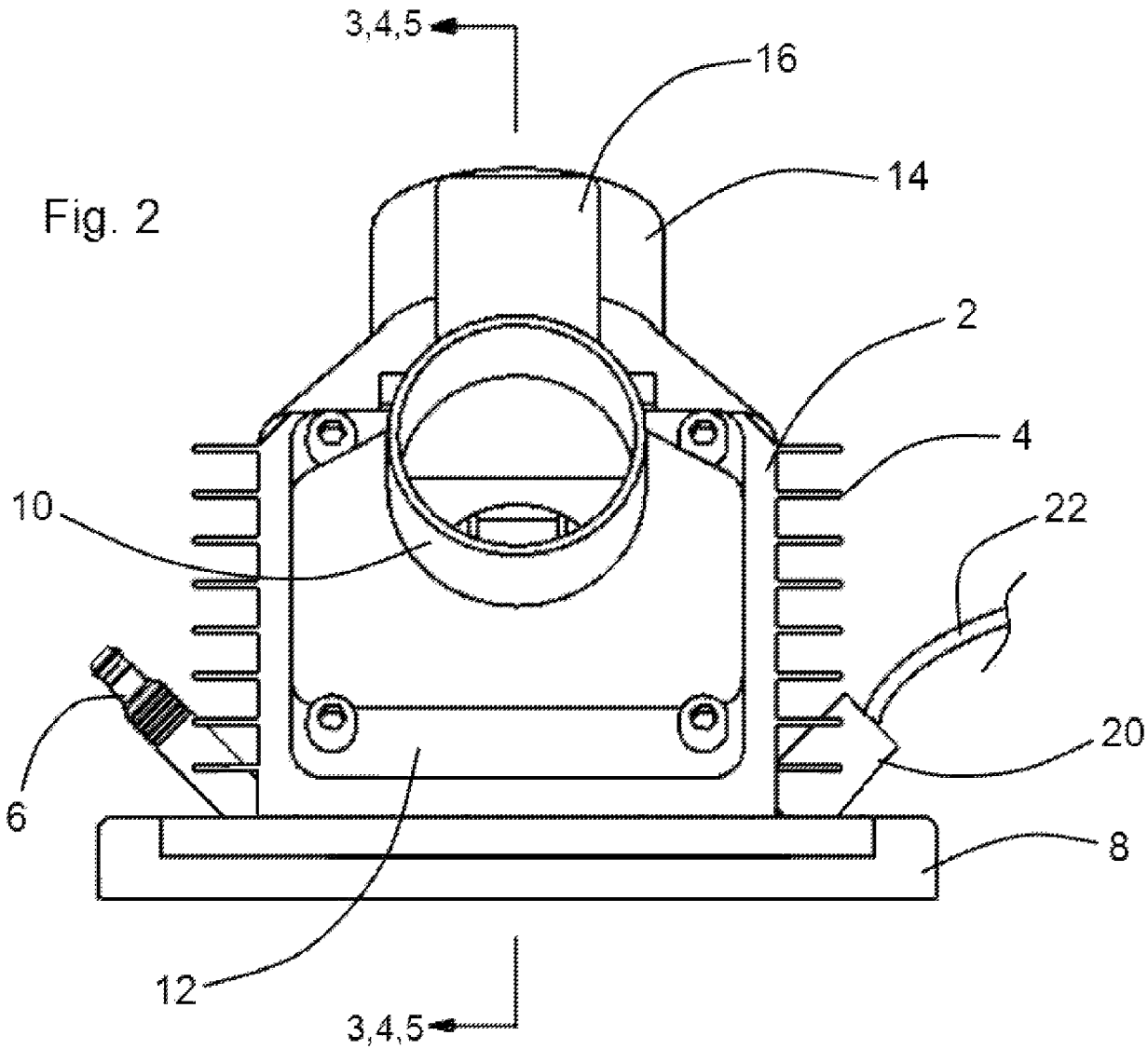
FIG. 2 is an alternate side view of the instant inventive gas channeling cylinder head assembly, the view of FIG. 2 depicting an intake port side of the assembly.
Figure 3:
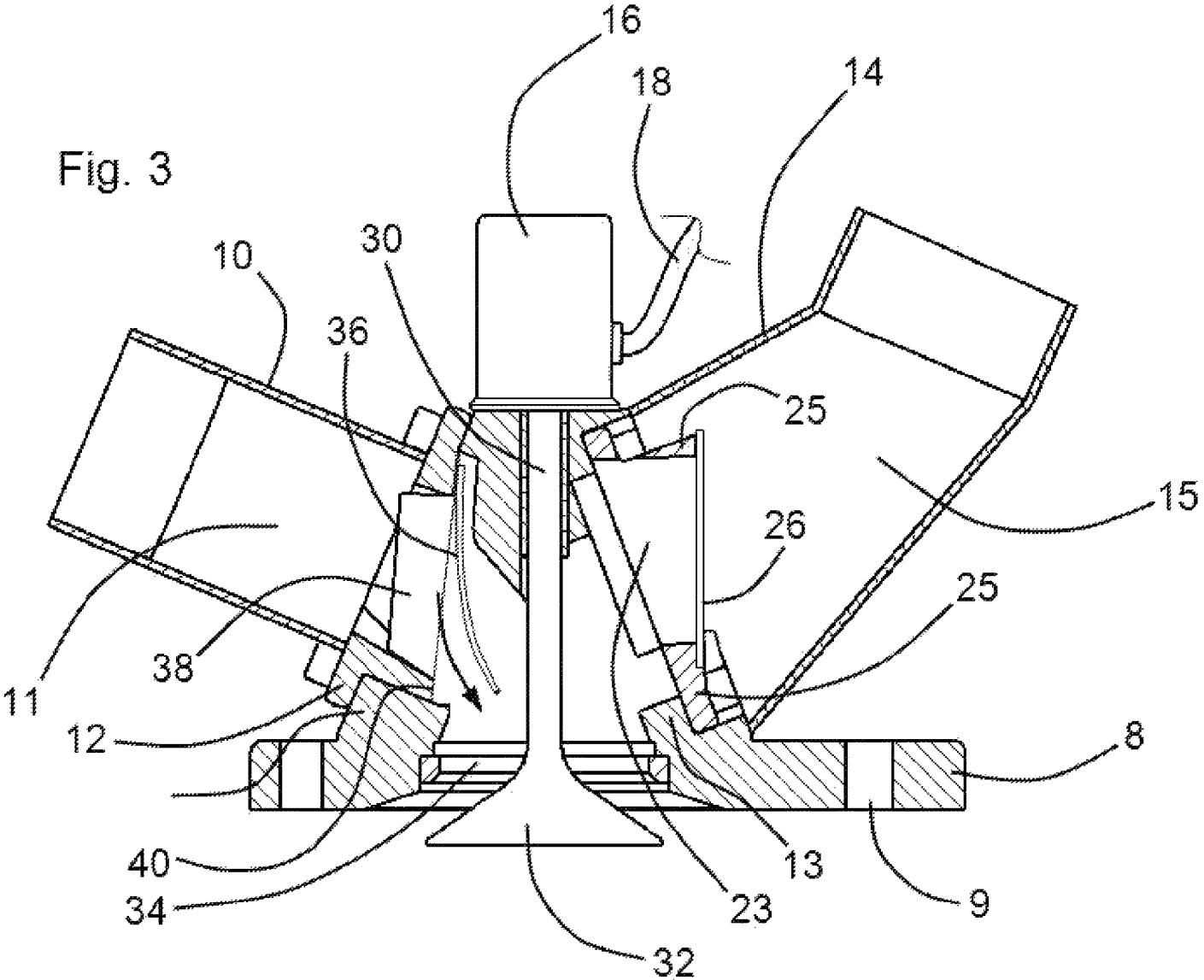
FIG. 3 is a sectional view as indicated in FIG. 2, the view of FIG. 3 depicting a valve configuration occurring upon a four cycle engine piston intake stroke.

Referring simultaneously to FIGS. 1, 2, and 3, the outer aspect of the base 8 preferably presents mounting flanges 13 to which a hollow steel or aluminum alloy cap 2 having heat dissipating fins 4 is preferably fixedly attached. The heat dissipating fins 4 are intended as being representative generally of conventionally known means for cooling internal combustion engine cylinder heads including both air cooling structures and water jackets (not depicted) for liquid cooling. The base 8 in combination with the cap 2 advantageously form and define a hollow gas flow controlling plenum.

Referring further simultaneously to FIGS. 1-4, the gas flow controlling plenum which is formed by the cap 2 and the base 8 preferably comprises a first port 34, a second port 38, and a third port 23. The first port 34 extends through the steel base 8 and is preferably circular, presenting an annular poppet valve seating surface 33. A reciprocatingly moveable poppet value consisting of a conical foot 32 and a valve stem 30 formed wholly with the foot 32, preferably extends through the hollow interior of the defined plenum, the conical foot 32 of such valve being matchingly seatable against the annular seating surface 33. The outer end of the poppet valve stem 30 is preferably connected operatively to an electric solenoid linear actuator 16 which normally spring biased to a closed position and whose coil is powered by an electric cable 18. The solenoid actuator 16 is preferably mounted externally upon the cap 2. The depicted solenoid linear actuator 16 is intended as being representative of commonly known reciprocating linear motion actuator assemblies such as pneumatic cylinders, hydraulic cylinder assemblies, and cam shaft and rocker arm assemblies, and electric servo motor driven actuators.

Figure 4:
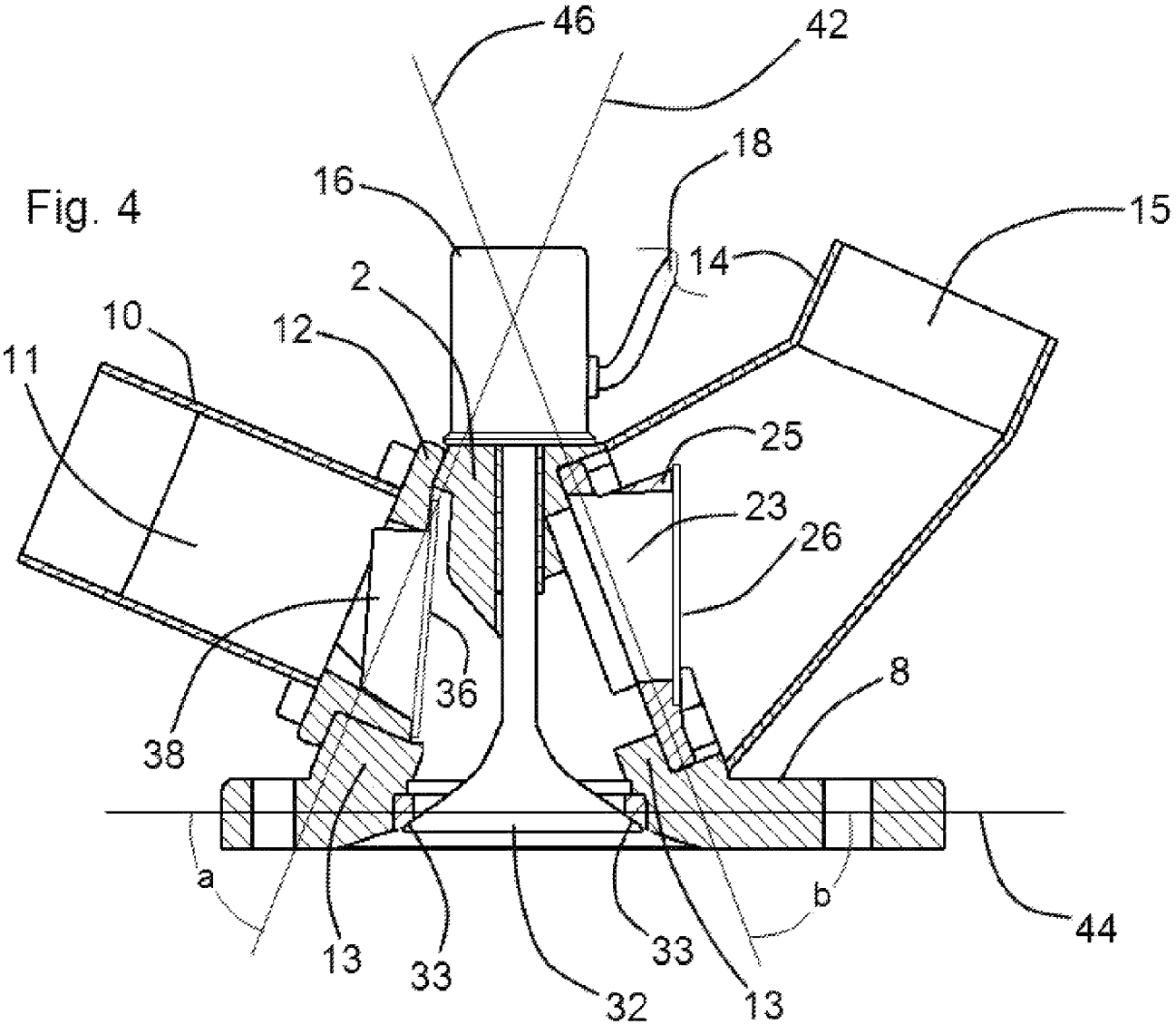
FIG. 4 redepicts FIG. 3, the view of FIG. 4 alternately depicting a valve configuration occurring upon the piston's compression stroke or power stroke.
Figure 5:
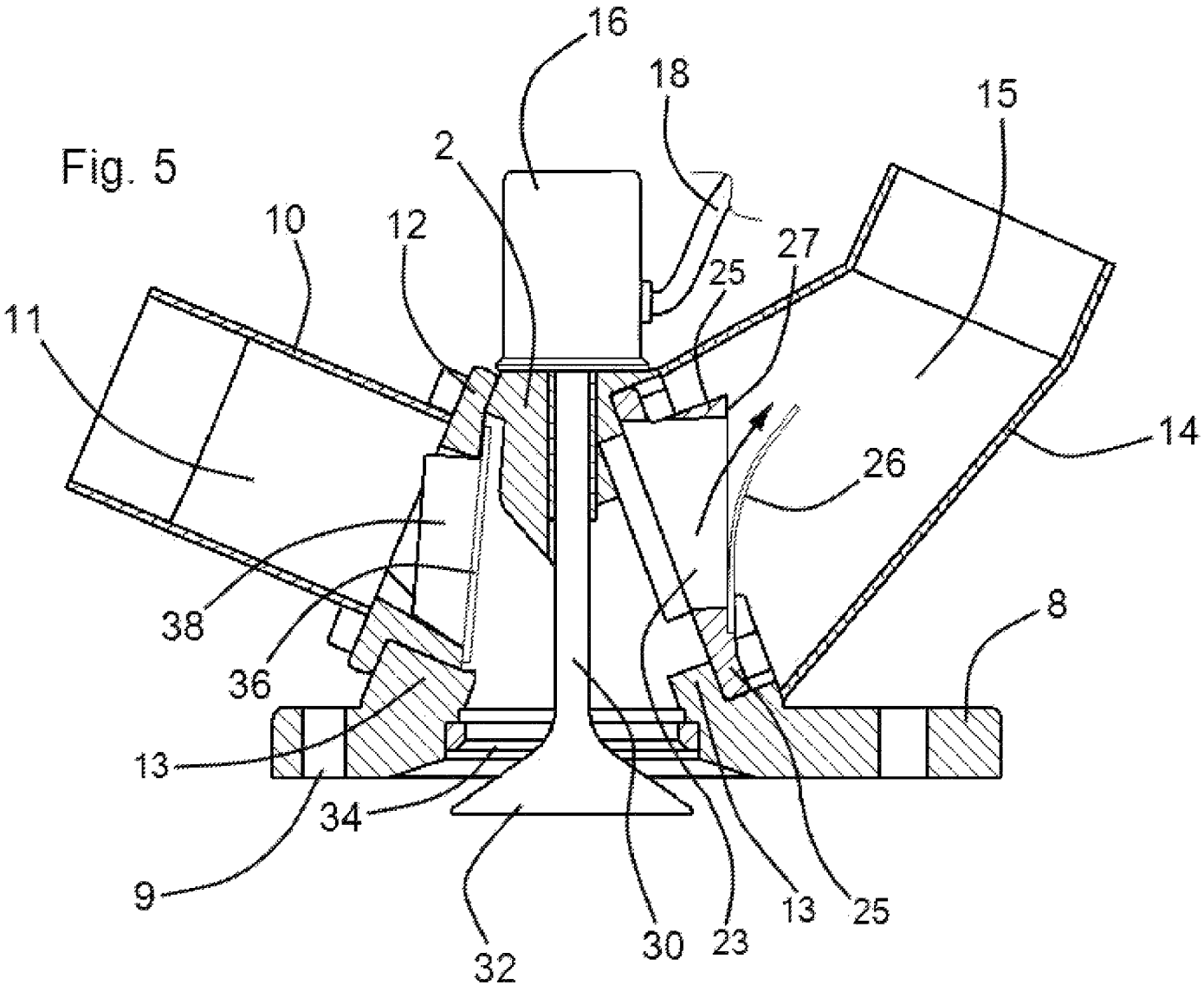
FIG. 5 alternately redepicts FIG. 3, the view of FIG. 5 showing a valve configuration occurring upon the piston's exhaust stroke.

Referring in particular to FIG. 4, the linear motion actuator 16 preferably seatingly holds the poppet valve 32 against its annular seating surface 33, as depicted, at least during portions of the compression and power strokes of an underlying piston (not depicted). Referring further to FIGS. 3 and 5, the actuator 16 oppositely unseats the poppet valve 32 from the seating surface 33 during at least portions of such piston's intake and exhaust strokes, such actuation allowing combustion and exhaust gases to pass inwardly and outwardly through the first port.

Referring simultaneously to FIGS. 2 and 3, inward combustion gas flow through the plenum's second port 38 is preferably controlled by a check valve 12 which is preferably fixedly bolted to the cap 2. The check valve 12 preferably presents an outwardly extending nipple 10 having a hollow bore 11, the nipple 10 being attachable in communication with an intake air conduit (not depicted). The check valve 12 preferably is of the reed valve type, comprising a flexible blade or reed 36, the flexible blade 36 preferably comprising a high strength, highly flexible, highly durable, and highly heat resistant material. As can best be seen in FIG. 2, the output or inner end of the nipple 10 is laterally widened for accommodating a laterally extending array of three or four of the blades 36, such lateral array checking gas back flow across such channel's lateral width.

Referring to FIG. 3, the blade 36 of the reed type check valve 12 preferably has a fixedly attached proximal end and a flexibly deflectable distal end opposite the proximal end. The fixedly attached proximal end of the blade 36 is preferably oriented with respect to the underlying first port 34 to so that such attachment resides at an end of port 38 which is opposite port 34. Such opposed orientation of the proximal end of the blade 36 advantageously allows the outer surface of the blade 36 to function in the manner of a gas directing vane upon inward flexible deflection induced by inwardly drawn combustion gases. The depicted opposed orientation of the proximal end of the blade 36 advantageously allows such vane to direct combustion gases in the direction indicated by the arrow drawn on FIG. 3 toward the first port 34. Combustion gases which meet and inwardly traverse port 34 with enhanced velocity advantageously enhance the fuel and energy efficiency of an engine which incorporates the inventive cylinder head assembly 1.

Referring simultaneously to FIGS. 3 and 4, the poppet valve foot 32 will typically be seated against annular seating surface 33 at the end of the power stroke of an underlying piston. (Not depicted) Near the commencement of such piston's exhaust stroke, the linear motion actuator 16 moves the poppet valve 32 from the position depicted in FIG. 4 to the position depicted in FIG. 3, such linear motion opening the first port 34 and allowing exhaust gases to be driven outwardly therethrough and into the interior of the plenum.

Referring further simultaneously to FIG. 5, pressurized flows of exhaust gases into the plenum outwardly displace the flexible blade 36, causing its distal end to seat against seating surface 40 of the second intake port 38, such valve seating closing such port against back flow of gases into the combustion air intake channel 11.

Referring simultaneously to FIGS. 3 and 5, a second check valve 25 is preferably further provided for controlling flows of exhaust gases through the third port or exhaust port 23. The second check valve 25 preferably is, similarly with valve 12, of the reed valve type, such valve having a light, flexible, and heat resistant blade 26. An exhaust gas manifold 14 overlying the third port 23 and defining an exhaust gas channel 15 is preferably fixedly attached to the cap 2. Upon piston drawn aspiration of combustion gases, as signified by the arrow drawn upon FIG. 3, negative gas pressure within the plenum inwardly deflects the reed valve blade 26 causing the distal end of such blade 26 to seat against seating surface 27, sealing the third port 23 against any aspirating back flow of exhaust gases which might reside within channel 15. Opposite positive exhaust gas pressure occurring upon such piston's exhaust stroke, as described above, outwardly deflects blade 26 allowing emission of the exhaust gases in the direction of the arrow drawn upon FIG. 5, while simultaneously seating blade 36 against the opening of the second port 38.

Referring simultaneously to FIGS. 3 and 4, it may be observed that the opening of the first port 34 coincides with a horizontal plane which is represented by reference line 44, that the opening of the second port 38 coincides with an angularly displaced plane which is represented by reference line 32, and that the opening of the third port 23 coincides a separate angularly displaced plane which is represented by reference line 46. Preferably, the plenum which is defined by the cap 2 and the base 8 is triangularly configured so that the planes 44 and 42 which coincide with ports 34 and 38 are angularly displaced away from each other at an acute angle "a". Such respective angular orientation of the first and second ports 34 and 38 advantageously tilts the opening of the second port 38 toward the first port 34, beneficially increasing the velocity vector component of intake gases which is directed toward the first port 34.

Referring further simultaneously to FIGS. 3 and 4, such triangular configuration of the plenum also advantageously angularly tilts the opening of the third port 23 toward the first port 34 at a similar acute angle "b" for enhancing the ability of the third port 23 to capture and expel piston driven exhaust gases.

Referring further simultaneously to FIGS. 3 and 4, the configuration of the plenum and its ports to include acute angles "a" and "b" additionally advantageously serves the function of reducing the interior volume of the plenum and reducing the quantity of exhaust gasses which may be sequestered within the plenum between the piston's exhaust strokes.

Referring simultaneously to FIGS. 1 and 2, it is preferred that the base plate component 8 of the inventive cylinder head assembly 1 include angled channels into which an angled spark plug 6 may be mounted and into which a conventional fuel injector 20 supplied by fuel injector line 22 may be mounted. The spark plug 6 and the fuel injector 20 are preferably actuatable in a timed fashion, along with timed actuation of the poppet value actuator 16, in coordination with the four strokes of an underlying piston, and in a manner conventionally known to those skilled in the art.

Referring simultaneously to FIGS. 3, 4, and 5, it may be observed that the sole mechanically actuated valve of the assembly is the poppet valve 32. Elimination of other mechanically actuated valves at the second and third ports 38 and 23, along with the provision of preferably light weight gas flow actuated check valves at those ports, enhances the energy efficiency of an engine upon which the inventive cylinder head may be installed.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A gas channeling cylinder head assembly for fixed attachment to a cylinder, the cylinder having a slidably mounted piston, the piston being cyclically moveable within the cylinder, said assembly comprising:

(a) a plenum comprising a triangularly configured cap, the plenum having a first port, a second port, and a third port, the first port, upon said fixed attachment, communicating with the cylinder;

(b) a poppet valve;

(c) actuating means connected operatively to the poppet valve for alternatingly seating and unseating the poppet valve at the first port; and (d) a check valve connected operatively to the plenum, the check valve being adapted for alternatingly permitting and resisting inward and outward flows of the gas through the second port.

2. The gas channeling cylinder head assembly of claim 1 wherein the check valve comprises a vane adapted for movement between flow permitting and flow resisting positions, the vane being positioned for, upon movement to the flow permitting position, directing flows of the gas toward the first port.

3. The gas channeling cylinder head assembly of claim 2 wherein the check valve comprises a reed valve having at least a first flexible blade, the vane comprising the at least first flexible blade.

4. The gas channeling cylinder head assembly of claim 3 wherein the at least first flexible blade has a fixedly attached proximal end, and a flexibly deflectable distal end.

5. The gas channeling cylinder head assembly of claim 4 wherein the actuating means comprises a linear motion actuator selected from the group consisting of cam shaft and rocker arm assemblies, electric solenoid actuators, electric servo motor actuators, hydraulic actuators, and pneumatic actuators.

6. The gas channeling cylinder head assembly of claim 2 further comprising a second check valve connected operatively to the plenum, the second check valve being adapted for alternatingly permitting and resisting outward and inward flows of the gas through the third port.

7. The gas channeling cylinder head assembly of claim 6 wherein the second check valve comprises a reed valve having at least a first flexible blade.

8. The gas channeling cylinder head assembly of claim 7 wherein the at least first flexible blade comprises a fixedly attached proximal end and a flexibly deflectable distal end.

9. The gas channeling cylinder head assembly of claim 8 wherein the actuating means comprises a linear motion actuator selected from the group consisting of cam shaft and rocker arm assemblies, electric solenoid actuators, electric servo motor actuators, hydraulic actuators, and pneumatic actuators.

10. The gas channeling cylinder head assembly of claim 1 wherein the first port opens the plenum at a first plane, wherein the second port opens the plenum at a second plane, and wherein the first and second ports' openings are oriented so that the first and second planes are acutely angled away from each other.

11. The gas channeling cylinder head assembly of claim 10 wherein the third port opens the plenum at a third plane, and wherein the third port's opening is oriented so that the first and third planes are acutely angled away from each other.

12. The gas channeling cylinder head assembly of claim 11 wherein the check valve comprises a vane adapted for movement between flow permitting and flow resisting positions, the vane being positioned for, upon movement to the flow permitting position, directing flows of the gas toward the first port.

13. The gas channeling cylinder head assembly of claim 12 wherein the check valve comprises a reed valve having at least a first flexible blade, the vane comprising the at least first flexible blade.

14. The gas channeling cylinder head assembly of claim 13 wherein the at least first flexible blade comprises a fixedly attached proximal end and a flexibly deflectable distal end.

15. The gas channeling cylinder head assembly of claim 14 wherein the actuating means comprises a linear motion actuator selected from the group consisting of cam shaft and rocker arm assemblies, electric solenoid actuators, electric servo motor actuators, hydraulic actuators, and pneumatic actuators.

16. The gas channeling cylinder head assembly of claim 11 further comprising a second check valve connected operatively to the plenum, the second check valve being adapted for alternatingly permitting and resisting outward and inward flows of the gas through the third port.

17. The gas channeling cylinder head assembly of claim 16 wherein the second check valve comprises a reed valve having at least a first flexible blade.

18. The gas channeling cylinder head assembly of claim 17 wherein the actuating means comprises a linear motion actuator selected from the group consisting of cam shaft and rocker arm assemblies, electric solenoid actuators, electric solenoid actuators, hydraulic actuators, and pneumatic actuators.

* * * * *